United States Patent [19]

Möllmann

[11] 4,407,043

[45] Oct. 4, 1983

[54] UNDER CARRIAGES FOR SLIDING DOORS HAVING SYMMETRICAL WEIGHT DISTRIBUTION

[76] Inventor: Erwin Möllmann, Neueromasch 6, 4520 Melle 1, Fed. Rep. of Germany

[21] Appl. No.: 224,660

[22] Filed: Jan. 13, 1981

[30] Foreign Application Priority Data

Jan. 16, 1980 [DE] Fed. Rep. of Germany ..... 3001341

[51] Int. Cl.[3] ..... E05D 13/02

[52] U.S. Cl. ..... 16/100; 16/DIG. 1; 104/279; 384/422

[58] Field of Search ..... 16/97, 100, 102, 107, 16/DIG. 1, DIG. 7; 49/40, 41, 425; 308/136, 137, 140; 105/179, 180; 104/279, 280; 384/193, 421, 422

[56] References Cited

U.S. PATENT DOCUMENTS

| | | | |
|---|---|---|---|
| 2,070,437 | 2/1937 | Kjolseth | 308/137 |
| 2,646,949 | 7/1953 | Saulnier | 49/425 X |
| 3,120,683 | 2/1964 | Harris | 49/425 X |
| 3,241,283 | 3/1966 | Ahlgreen | 49/425 |
| 3,305,952 | 2/1967 | Dressler | 104/279 X |
| 3,614,803 | 10/1971 | Matthews | 16/97 X |
| 3,745,706 | 7/1973 | Stermac | 49/425 |
| 3,866,539 | 2/1975 | Gasser | 104/279 X |

*Primary Examiner*—Fred Silverberg

*Attorney, Agent, or Firm*—Balogh, Osann, Kramer, Dvorak, Genova & Traub

[57] ABSTRACT

This invention relates to under carriages for supporting and displacing heavyweight sliding doors. Two spaced carriages 10 and 11 are arranged to run on a trackrail 6 which is cemented into the ground. Each of the carriages comprises two track wheels 19 and 20 situated one behind another and these track wheels each have flanges 21 at each side to enflank the head 15 of the track. The track wheels are also joined to a rigid beam which includes a spheroidal seat bearing 25 into which engages a calotte 26 having a plane upper surface which fits into a matching recess in a door frame 27 to carry the weight of the door, (FIG. 3).

5 Claims, 5 Drawing Figures

UNDER CARRIAGES FOR SLIDING DOORS HAVING SYMMETRICAL WEIGHT DISTRIBUTION

BACKGROUND OF THE INVENTION (1) Field of the Invention

The present invention relates to under carriages for supporting and displacing sliding doors at two spaced positions arranged to run on a trackrail embedded in concrete.

(2) Description of the Prior Art

Sliding doors, such as those used to close bombproof hangers, are extremely ponderous, each door half weighting about 90 tons for a length of 11 meters, for example. Each half-door of known sliding doors of this nature have run in each case via two so-called under carriages on a double-T rail set in concrete, having a height of, say, 60 cms, the track surface of which must be aligned horizontally with extreme precision. The carriages in these known systems comprise a rigid guiding system joined to the sliding door, with a roller chain circulating around the guiding system, comprising cylindrical rollers of a small diameter of approximately 5 cms, which imply a specially hardened surface of the track rail. The slightest deviation from the horizontal of the track rail surface and even minute soiling, e.g. sand and stones on the track rail, lead to highly different loads on the small track rollers which then fracture and, by leaving fragments on the track rail, also damage the other track rollers and thereby the under carriage as a whole. This may have the result that the displacement of the door halves becomes impossible. The resultant necessary dismantling of the carriages and substitution of new carriages is extremely difficult to perform. It has been attempted to prevent unequal loading on the rollers of the carriages by incorporating a neoprene layer between the door and the carriage, but is was observed that this plastics material or any analogous material begins to undergo flowage after a particular period, so that the aforesaid disadvantages arise again in an enhanced form.

SUMMARY OF THE INVENTION

It is an object of the invention to minimise or prevent unequal loads on individual rolling elements of a dolly, to avoid the sensitivity of existing rolling members even if stones or other solids are present on the track rail, and finally substantially to simplify the assembling and disassembling of the carriages.

Accordingly, the invention consists of under carriages for supporting and displacing heavy weight or highly heavy sliding doors at two spaced positions arranged to run on a track rail, wherein each of the carriages includes two track wheels situated one behind another with respect to the direction of the track rail, the track wheels each having flanges to enflank or overlap the track rail on both sides, and for forming each of the carriages said track wheels each being joined to a rigid beam which has a spheroidal seat bearing in the central or mid point between the two track wheels into which bearing engages a calotte the plane upper surface of which fits loosely into a matching recess formed in a frame of the door and each carriage bears the corresponding proportion of the weight of the door.

The two track wheels have a large diameter, which in this context means between 30 and 60 cms, and these are installed in each carriage. Due to this arrangement, the individual wheels are always loaded in wholly symmetrical manner, since the proportion of the door weight is transmitted centrally to the carriage via the spheroidal or hemispherical calotte or by a frustum thereof, and the carriage may swivel around the centre of the spheroidal calotte if solids are present on the track or there is any other unevennesses of the track rail. The symmetrical weight distribution onto the two track wheels however always remains the same. Since there is no firm connection between the door or door frame and the carriage it is possible if it is required to replace the carriage, to lift the door a little by means of appropriate hoists, thereby automatically freeing the carriage from the door, leaving the same on the track rail and thereby allowing the same to be removed and replaced.

Advantageously, each carriage comprises a downwardly open channel beam with two legs, both of which have journalled in them the axles of the two track wheels one behind the other and the spheroidal seat bearing for the spheroidal calotte or for a frustum of the latter may be centrally arranged on the web of said beam. A particularly simply structure of the carriage is thus possible.

It was found that the under carriages in accordance with the invention satisfactorily overcome uneveness of the track rail and solids on the track rail, such as sand and stones, without any damage being incurred, but it is advantageous to fit the sliding doors and the carriages in such manner that the track rail surface, which need no longer be of hardened material as heretofore, and troughs at both sides of the track rail into which the flanges of the track wheel partially project, are always kept clear, as will be more fully explained hereinafter.

In order that the invention may be more clearly understood, reference will now be made to the accompanying drawings which illustrate one embodiment thereof by way of example and in which:

DESCRIPTION OF THE PREFERRED EMBODIMENT

Figure 1:
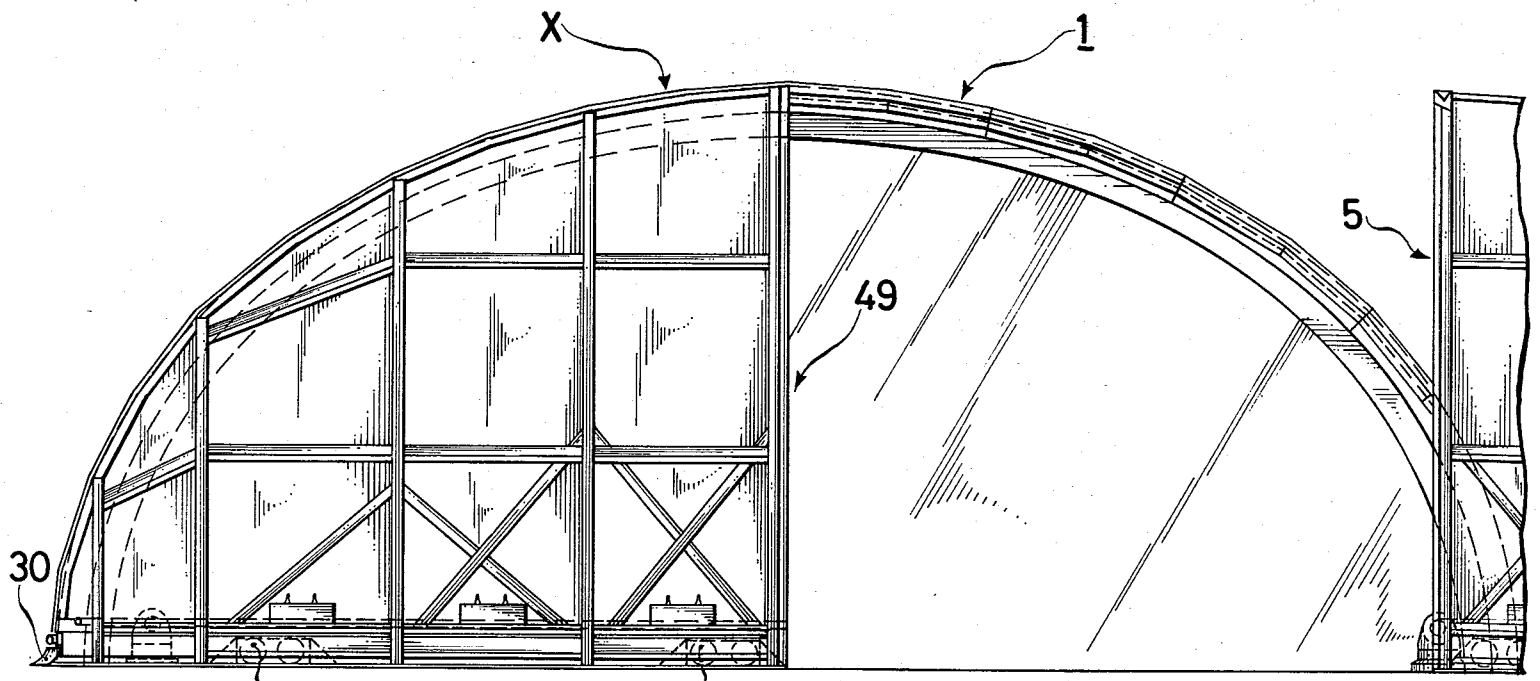
FIG. 1 shows an end view of a hanger with one half door closed and the other open.

Referring now to the drawings, in order to protect aircraft from bomb attack and other war-like activities, hangars 1 are built as bomb-proof as possible, e.g. they comprise a shed or hall assembled from plates 2 (FIG. 2), a concrete layer 3 which assures protection being applied on the plates. Such hangers 1 are closed off at one end or side by preferably double-sided doors or gates 4 and 5, which match the hanger cross-section and comprise a steel frame filled with concrete. Such half-doors 4 and 5 are extremely heavy e.g. they may weight 90 tons for a length of, say 11 meters. Such doors are made to be displaced for opening and closing purposes on a rail 6 embedded in a concrete floor and having a length of, say, 23 meters, by means of an electric motor 7 and of a rack or toothed bar 8. The half doors 4 and 5 are generally additionally supported on the outside by an outrigger 9 (FIG. 2) which also comprises a frame-like steel structure incorporating a concrete layer if possible.

Figure 2:
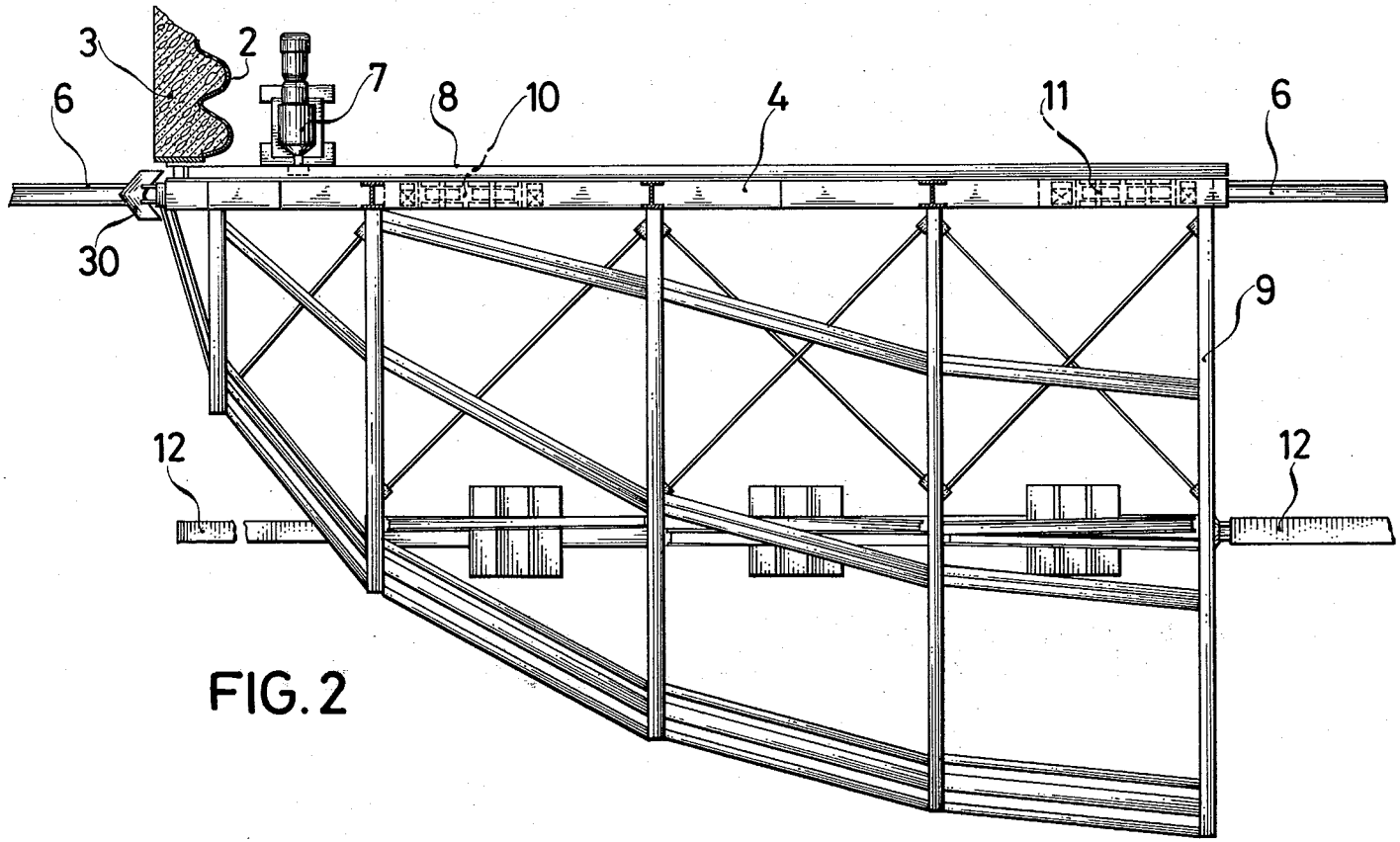
FIG. 2 shows a plan view of a half door comprising a supporting outrigger as seen in the direction of the arrow x of FIG. 1.
Figure 3:
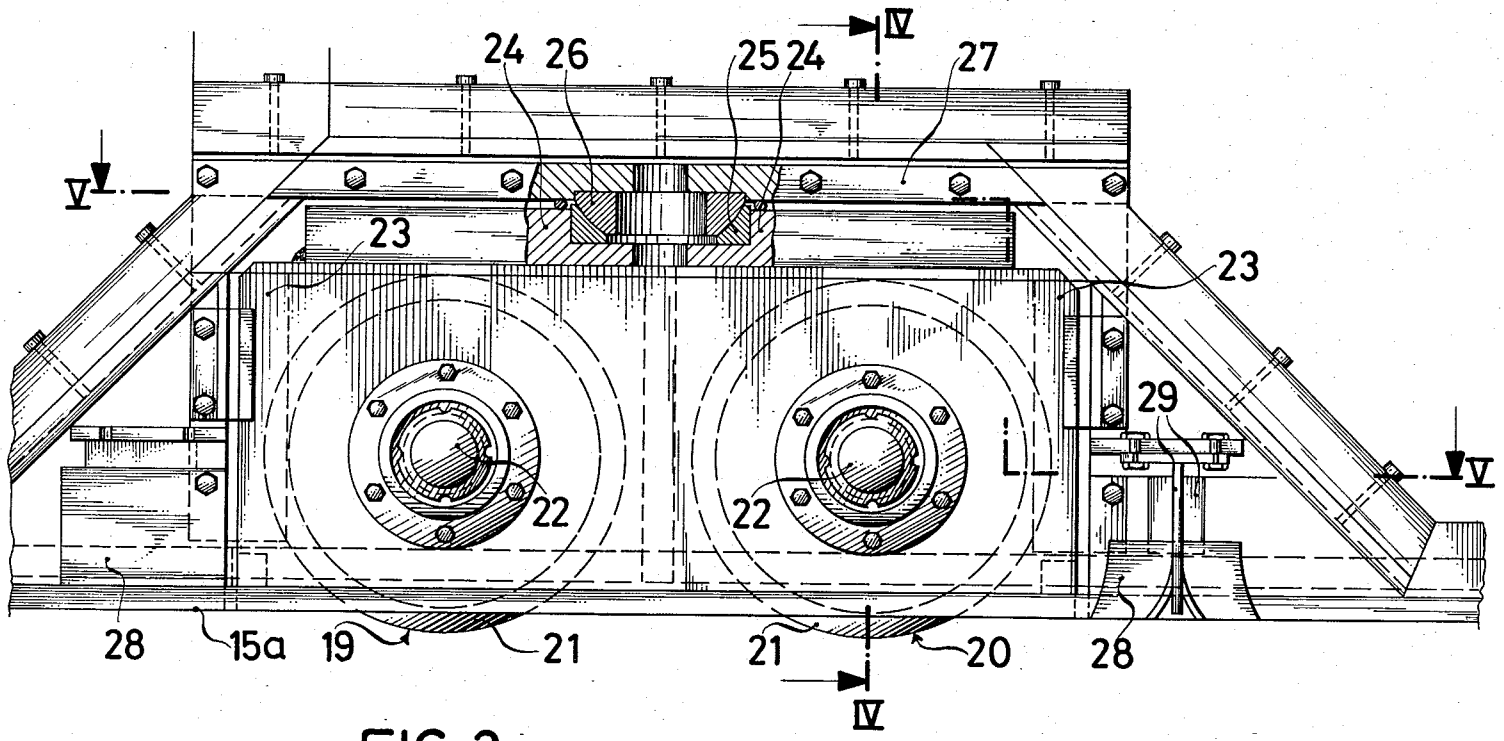
FIG. 3 shows a side view of one of the under carriages for the half doors according to FIGS. 1 and 2.

The half doors 4 and 5 run on the rail 6 via two under carriages 10 and 11 in each case, shown in FIGS. 1 and 2, and the supporting outrigger 9 of the door also runs via one or more further carriages on a rail 12 parallel to the rail 6.

Figure 4:
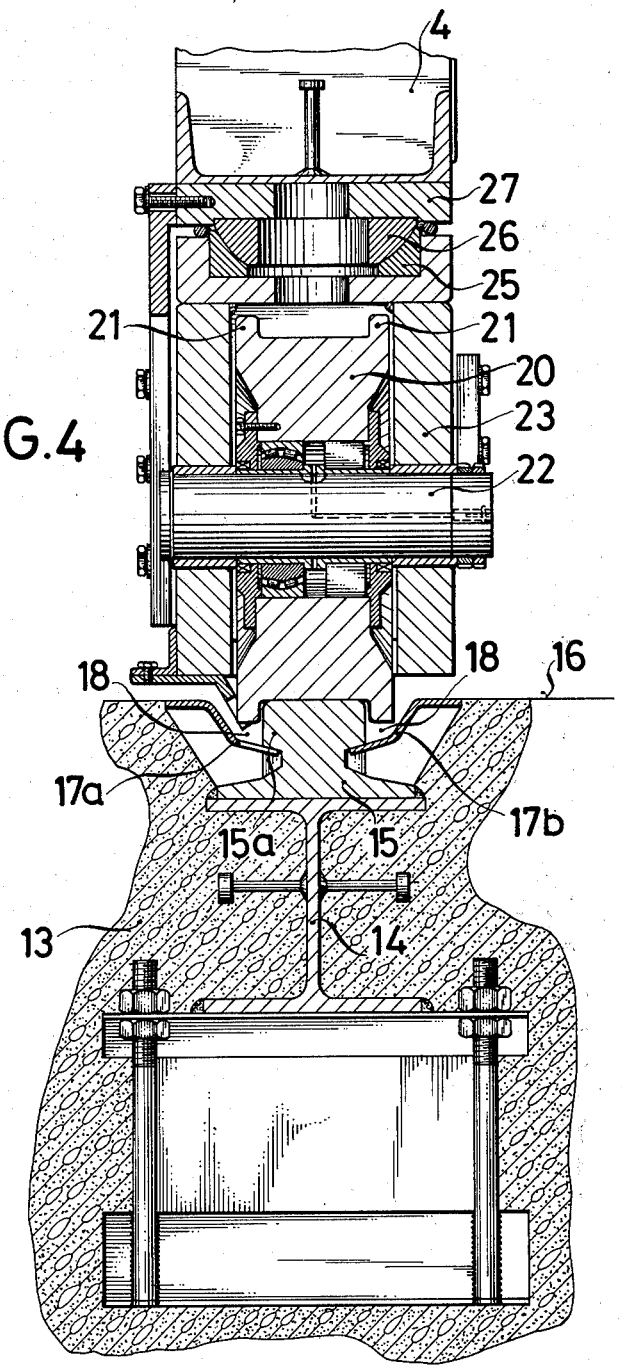
FIG. 4 shows a cross-section along line IV-IV of FIG. 3.
Figure 5:
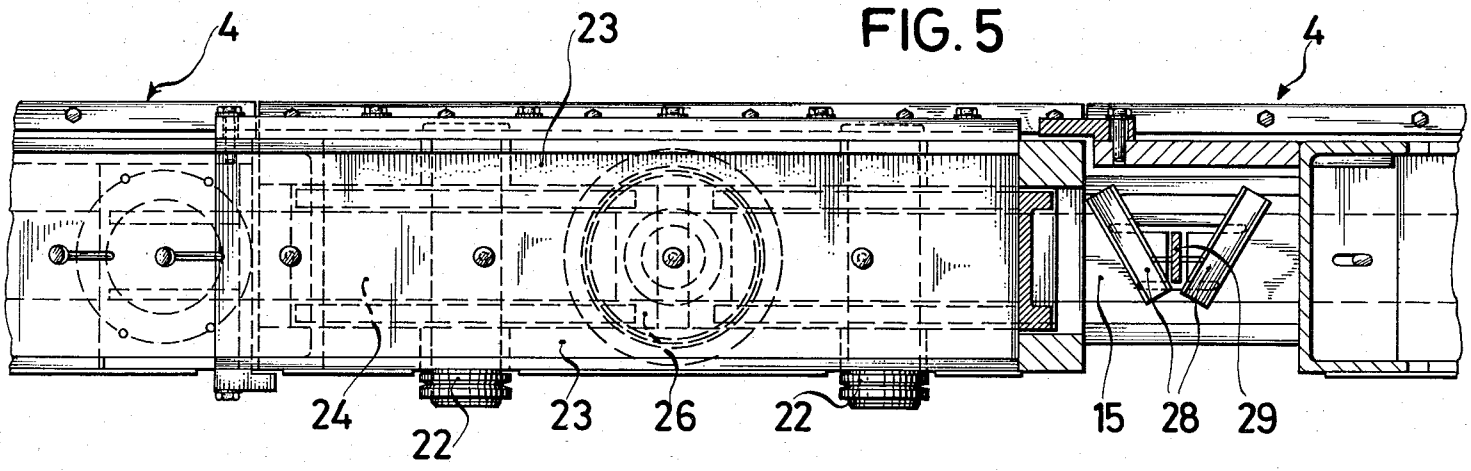
FIG. 5 shows a plan view of the under carriage according to FIG. 3, as seen from line V-V of FIG. 3.

In the embodiment, the track rail 6 for the door or gate comprises a double-T rail 14 anchored in the concrete floor 13 (FIG. 4) which has welded to it a railway track rail or a crane track rail 15 the upper surface of which extends flush with the surface 16 of the concrete floor. The undersides at either side of the head 15*a* of the rail 15 have welded to them plates 17*a* and 17*b* which, with the two lateral surfaces of the head 15*a*, in each case form troughs 18 whose external side or wall is outwardly and upwardly oblique or inclined so as to create the possibility (or facilitate) of keeping these two troughs clean as will be described in the following.

In accordance with the invention, the carriages 10 and 11 of each half door 4, 5 are constructed in the following manner. Each carriage comprises two track wheels 19 and 20 for running upon the trackrail comprising flanges 21 at each side, which enflank or overlap the rail head 15*a* and project into the troughs 18 at each side. The two track wheels 19 and 20, whose diameter advantageously amounts to between 30 and 60 cms, have their axles 22 journalled in a rigid beam. This beam advantageously is a channel beam, in whose two legs 23 the axles 22 of the two track wheels 19 and 20 are journalled. The advantageously reinforced beam web 24 overbridging the two legs 23 is fitted at the central or mid point between the two wheels 19 and 20 with an upwardly-open recess or excision into which is inserted a bearing cup 25 which is spheroidal or resembles a spheroidal or hemispherical cup. Into this bearing cup 25 is loosely inserted from above a calotte 26 or a frustum 26 of the latter having a planar upper surface which bears against the underside of the steel frame 27 of the door panel 4 or 5, the calotte 26 engaging or being reclined in a shallow recess of the door frame 27 to secure an entraining connection between the door and the carriage.

The two carriages 10 and 11 constructed in the aforesaid manner each bear the corresponding proportion of the weight of each half door or of each door symmetrically distributed to the two wheels 19 and 20, the carriages on the one hand being guided in the longitudinal direction by the flanged wheels and being entrained during displacement by the motor 7 and rack 8, by the fact that the calotte 26 has its upper section engaging a little in the recess in the underside of the steel frame 27 of the door, as already stated.

If any solid detritus e.g. gravel, small or large stones, are present on the track rail surface, these are overcome without difficulty, on the one hand by means of the large diameter of the wheels 19 and 20, and on the other hand because the carriage is pivotable around the centre of the spheroidal cup bearing 25 or of the calotte 26, without alterting the symmetrical weight distribution on the two wheels 19 and 20.

The pivotable carriages 10, 11 have the advantage that in case of possible sudden vertical displacements of the doors, e.g. caused by explosion of bombs or the like, the door entrains the calotte 26 during such vertical displacement by adhesion, but the calotte 26 drops again afterwards into the spheroidal seat bearing 25.

The structure of the carriage has the additional advantage that it may easily be assembled and disassembled. These operations are performed by raising the entire door or the entire half door by means of hoists, so that the carriages may be withdrawn sideways after the door has been raised by at least the height of the flanges 21 plus the depth of the recess in the steel door frame 27 for the calotte. A replacement or a repair of the carrige may then be performed easily and conveniently.

It is naturally advantageous to keep the surface of the track rails 6 and 15, as clean as possible upon displacing the doors. To this end, a plough-share-like block 28 of the carriage is installed slidably in vertically displaceable manner on a guide 29 in front of and behind each carriage 10, 11, and this heavy block 28, e.g. consisting of metal, may move vertically on the guide 29 which preferably has a cruciform reinforcement. These ploughshare-like blocks 28 keep the rail surface clean during displacement of the doors.

It is equally advantageous to keep the two troughs 18 at either side of the rail 15 clean, in particular whilst opening the half doors 4, 5. To this end, the external base extremity of the half door has arranged on it a ploughshare-like slider 30 (FIGS. 1 and 2) which slides along the rail surface and which at either side and adjacent the rail 6 and 15 has small ploughshares which match the cross-section of the troughs 18 and push any particles of sand, stones or other solid parts outwards out of the troughs.

As a rule, the half doors 4 and 5 are braced against tipping at the outer side by means of the outrigger 9 (FIG. 2) already referred to. A supporting outrigger of this kind, comprising a steel frame, should equally be displaceable together with the door by means of one or more carriages running on a rail 12.

The carriage or carriages for the supporting outrigger 9 are constructed in practically the same manner as the main carriages 10 and 11 for the doors as such, but the two wheels of each carriage then run with a cylindrical periphery without flanges on the surface of the rail 12 extending flush with the concrete floor surface. Since track flanges are absent, the spheroidal bearing 25 incorporated in the carriages 10 and 11 is replaced by a transversely extending cylindrical bearing, and this bearing seat has loosely engaged in it a half-cylinder having a planar surface places in contact with a planar inferior surface of the supporting outrigger, that is to say advantageously being joined to the bottom surface element of the supporting outrigger by welding. Guiding of the wheels of the carriages on the rail 12 is assured by this cylindrical bearing structure. In this case too, it is possible to make use of ploughshare-like elements which slide along the rail 12 and keep the same clean, in front of and behind the dollies of the supporting outrigger.

If desired, each carriage may have more than two wheels e.g. four wheels may be rectangularly arranged in the form of a bogie.

I claim:

1. Under carriages in combination with and for supporting and displacing heavy-weight sliding doors at two spaced positions, said carriages arranged to run on a trackrail embedded in concrete, each of said carriages comprising two track wheels situated one behind another upon the trackrail, each of said track wheels having flanges to overlap the trackrail on both sides thereof, a rigid beam engaging each of said track wheels, and having a spheroidal seat bearing in a central point thereof between said two track wheels, a calotte having a plane upper surface and engaging said spheroidal seat bearing, and each of the sliding doors having a frame provided with a recess for receiving loosely the plane upper surface of said calotte, so as to secure an entraining connection between each of the sliding doors and a respective one of said carriages, whereby each of said carriages bearing a corresponding portion of the heavy-weight of the sliding doors.

2. Under carriages as claimed in claim 1, wherein each of said carriages comprises a channel beam having a web and a pair of legs, and each of said two track wheels provided with an axle journalled in said pair of legs one behind another, and wherein said channel beam is provided with the spheroidal seat bearing for said calotte, or a frustrum of said calotte, in the web thereof.

3. Under carriage, as claimed in claim 1, wherein the trackrail has a railway track or crane trackrail section provided with a head portion having lateral surfaces, and longitudinally extending plates welded to undersides of said head portion to form with said lateral surfaces a trough on each side of said head portion, the trough having an outer upwardly and outwardly inclined wall so as to facilitate keeping clean the same.

4. Under Carriages as claimed in claim 3, wherein each of said doors is provided at an outer end thereof with a ploughshare-like slider for running along the trackrail surface, said slider having at both sides of and adjacent to the trackrail ploughshares matching the troughs cross section and engaging the troughs.

5. Under carriages as claimed in claim 1, wherein each of said carriages is fitted in front of and behind thereof with a guide member and a ploughshare-like block which is slidably and vertically displaceably installed on said guide member.

* * * * *